United States Patent [19]

Barmettler

[11] Patent Number: 4,951,332

[45] Date of Patent: Aug. 28, 1990

[54] SAFETY HAMMOCK

[76] Inventor: Peter Barmettler, Allmendstrasse 9, CH-6374 Buochs, Switzerland

[21] Appl. No.: 361,253

[22] Filed: Jun. 5, 1989

[30] Foreign Application Priority Data

Jun. 6, 1988 [CH] Switzerland ..... 02152/88

[51] Int. Cl.[5] ..... A45F 3/22; A45F 3/24

[52] U.S. Cl. ..... 5/120; 5/127

[58] Field of Search ..... 5/127, 120, 128, 129, 5/130, 121, 122

[56] References Cited

U.S. PATENT DOCUMENTS 2,524,499 10/1950 Weir ..... 5/127

4,757,563 7/1988 An ..... 5/128

*Primary Examiner*—Alexander Grosz

*Attorney, Agent, or Firm*—Darby & Darby

[57] ABSTRACT

A hammock cot having a frame formed of a pair of U-shaped leg sets. A cradle has a center piece coupled to a rotatable bearing on the center part of each leg set. An end piece of the cradle which angles upwardly is also coupled to each bearing and each end of the hammock is fastened to the free end of a cradle end piece. A load on the hammock deflects each cradle end piece downwardly causing the bearings to rotate and bow upwardly the cradle center piece thereby reducing the force applied to the leg sets.

11 Claims, 2 Drawing Sheets

SAFETY HAMMOCK

BACKGROUND OF THE ART

Known hammock cots consist, in order to be independent of the local terrain for using the hammock, of an independent frame and a hammock. Such a frame consists of two skids curved in general banana shape which, as DE No. 27 02 593 shows, are firmly connected together, or, as CH-No. 473,553 shows, are collapsible. Both designs have the common disadvantage that they fail under overload and may tip over when rocked transversely. In both cases the user and the equipment are endangered.

The fear that such hammock cots might be dangerous for the users may be the reason why extensive use of the hammock has not taken place either in Europe or in North America.

BRIEF DESCRIPTION OF THE INVENTION

The present invention aims to eliminate the mentioned disadvantages and to provide further advantages for the user. Thus, a hammock with a collapsible frame is proposed which can be used by the user without bodily or material dangers, is easy to set up and to transport, and with appropriate awnings can even be used as a tent and as weather protection.

BRIEF DESCRIPTION OF THE DRAWINGS

The invention will be explained by way of example according to the attached drawing, in which.

DETAILED DESCRIPTION OF THE INVENTION

Figure 1:
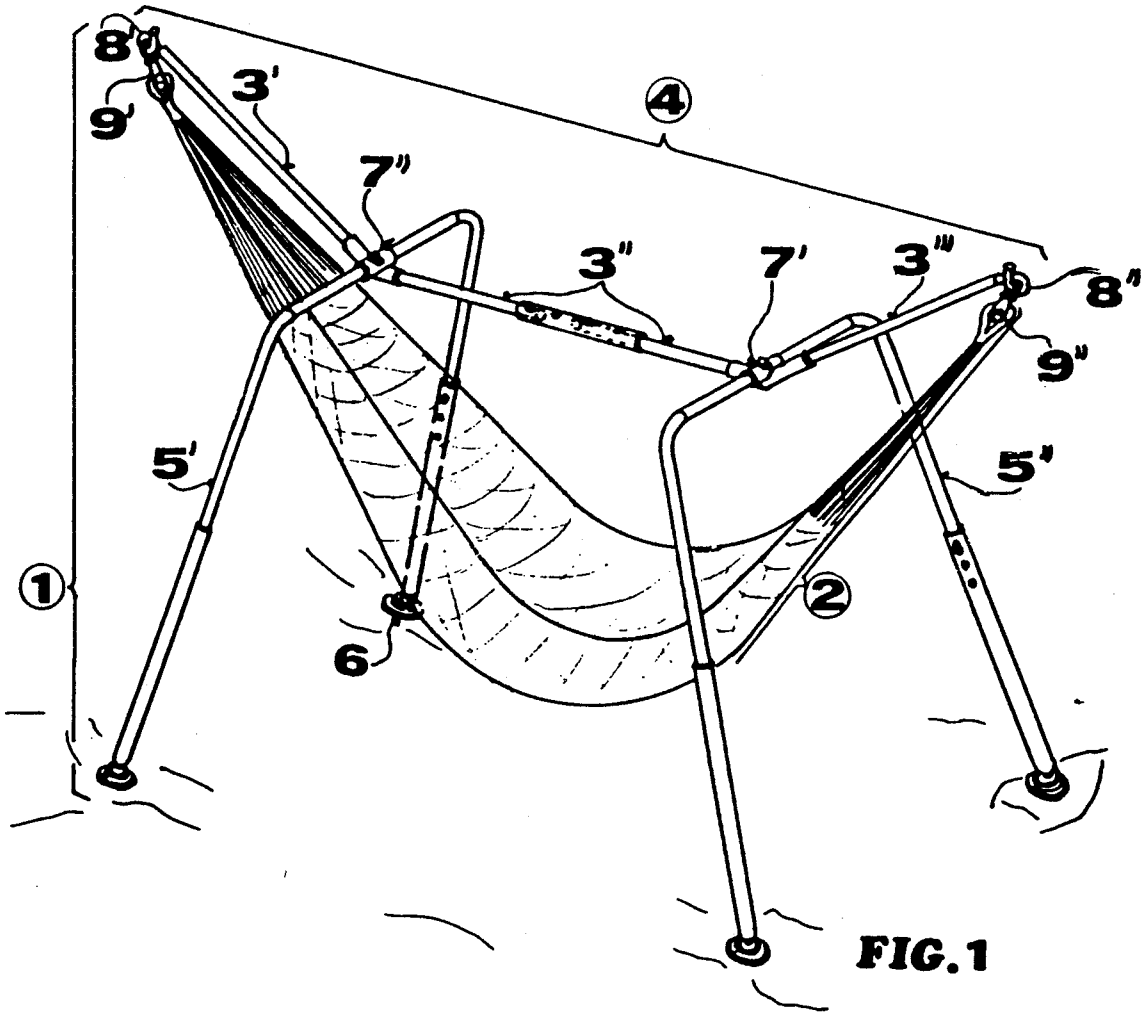
FIG. 1 shows a perspective view of the hammock cot.

The hammock cot 1 comprises in FIG. 1 a frame 4, with two generally U-shaped leg pairs 5', 5''. There is a foot pad 6 at the end of each leg 5' and 5''. There is a three-part cradle 3', 3'', 3''' whose parts are connected by the rotatable bearing joints 7', 7'' to the frame pieces 5', 5''. Each bearing joint 7', 7'' has a central sleeve which fits over the center part of the respective leg 5', 5''.

Each joint has a socket to accept one end of the cradle center piece 3''. This center piece 3'', as shown in FIG. 1 is formed by a center sleeve and a tube which telescopes into each end of the cradle center piece sleeve. The bearing 7', 7'' has a second socket which is at an angle to the first to accept an end of each cradle piece 3', 3'''. Each bearing 7', 7'' can rotate for a limited amount on the center part of its leg 5', 5'' as limited by the mounting bolts 12', 12'' (see FIG. 2). There is also a hammock 2 which is hooked in on the curved hook 9 on each of the free ends 8', 8'' of the cradle parts 3', 3''' by a rotatable bayonet hook 9', 9''.

Under load in the hammock, the outer sections 3' and 3''' of the cradle 3', 3''' function as cantilever beams and flex downwardly at the free ends like fishing rods. The middle part 3'' works under load as a bilaterally clamped beam at the bearing joint 7', 7'' and bends upwardly in a convex arc.

The deflection under load of the free end of cradle parts 3', 3'' rotates the closed bearings 7', 7'' and bows the middle part 3'' upwardly. This reduces the transmission of load into the legs 5', 5''.

Due to the fact that the load placed on the hammock 2 is taken up between the center legs of the leg pairs 5', 5'' at the bearings 7', 7'', transverse rocking of the frame 4 is limited and tilting of the frame 4 can be prevented.

Figure 2:
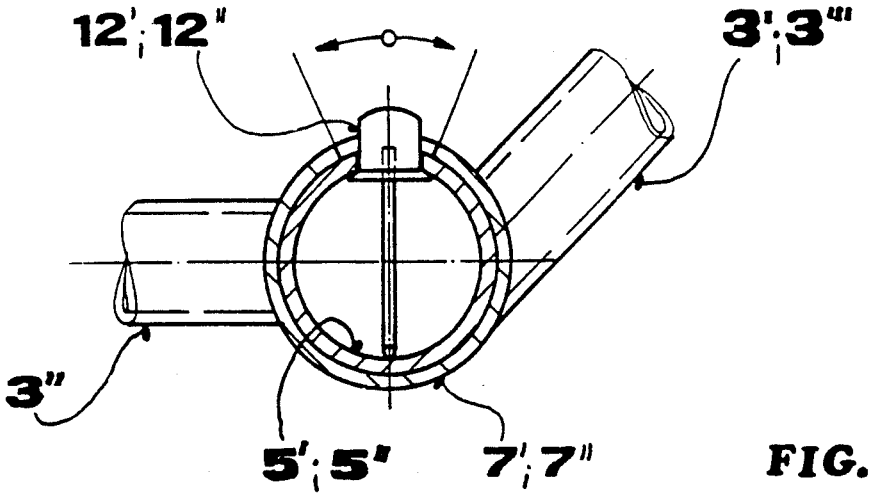
FIG. 2, a section through the bearing attachment.

As can be seen from FIG. 2, the center pieces of legs 5', 5'' are locked into the joints 7', 7'' by the bolts 12', 12'' so that spreading of the legs 5', 5'' and hence their position relative to the respective joint 7', 7'' is limited. Each bearing 7', 7'' has an enlarged opening 13 through which the bolt 12', 12'' passes, thereby permitting limited rotation of each bearing by the amount shown by the arrows and the lines designating the extensions of the opening.

The length of the legs 5', 5'' is determined by the full load on the hammock 2 so that it will still be above the ground. If in use this permissible load is exceeded, the hammock 2 lowers to the ground, and from that moment on it is no longer the hammock 2 and its frame 4, but the ground that is loaded by the otherwise dangerous load difference. Hence, there occurs neither permanent deformation nor breakage of the frame 4.

Figure 3:
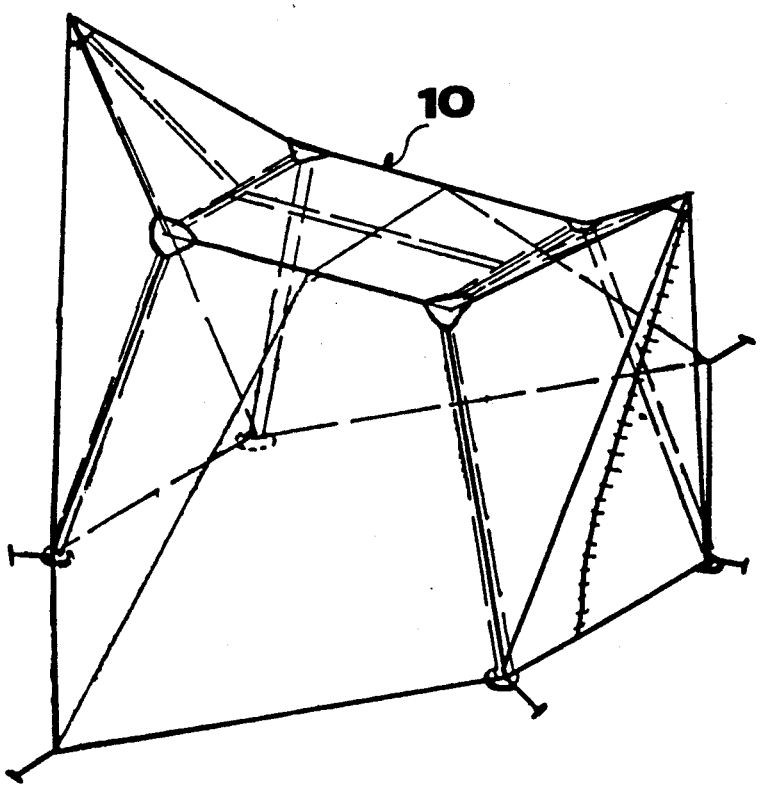
FIG. 3 shows the hammock cot used with an awning or tent for weather protection.

FIG. 3 shows a tent which is attached to each corner of the leg 5', 5'' and the end 8', 8'' of each cradle end piece 3', 3'''.

I claim:

1. A hammock cot comprising, a pair of leg sets, each set having a pair of legs with one end for contacting the ground and a central section, a rotatable bearing mounted on the central section of each leg set, a cradle having a center piece each end of which is coupled to one of the bearings and a pair of end pieces, each end piece having one end coupled to the bearing to extend outwardly from the respective leg set, a hammock, each end of the hammock coupled to the free end of a cradle end piece, a load on the hammock causing the cradle end pieces to deflect downwardly and rotate the bearings and to bow the cradle center piece upwardly.

2. A hammock cot as in claim 1, further comprising means to limit the rotation of the bearing relative to its leg set central section.

3. A hammock cot as in claim 2, wherein said means to limit rotation also connects the end of the cradle center piece to the leg set central section.

4. A hammock cot as in claim 1, wherein each bearing has a pair of sockets, the pieces of the cradle are rods and are coupled to the bearings by insertion into the sockets on the bearing.

5. A hammock as in claim 4, wherein the cradle center piece comprises telescoping tubular members to adjust its length.

6. A hammock as in claim 5, further comprising means to adjust the effective length of the telescoping tubular member.

7. A hammock as in claim 1, wherein the cradle center piece comprises telescoping tubular members.

8. A hammock as in claim 7, further comprising means to adjust the effective length of the telescoping tubular member.

9. A hammock cot as in claim 1, further comprising tent covering means fitting over the frame pieces.

10. A hammock as in claim 1, wherein as the cradle end pieces deflect downwardly the hammock lowers toward the ground.

11. A hammock as in claim 1, wherein each end of the hammock extends under the center section of a leg set in the space between the pair of legs, swinging of the hammock being limited by engagement of the hammock ends with the legs.

* * * * *